United States Patent [19]

Uesaki

[11] Patent Number: 4,990,789

[45] Date of Patent: Feb. 5, 1991

[54] ULTRA VIOLET RAYS GENERATOR BY MEANS OF MICROWAVE EXCITATION

[76] Inventor: Osamu Uesaki, 11-8, Kasukabe, Higashi 5-chome, Kasukabe-shi, Saitama Prefecture, Japan

[21] Appl. No.: 416,309

[22] Filed: Oct. 3, 1989

[30] Foreign Application Priority Data

May 10, 1988 [JP] Japan ..... 63-130728[U]

[51] Int. Cl.[5] ..... H05B 41/24

[52] U.S. Cl. ..... 250/504 R; 250/493.1; 315/39; 315/248; 313/113

[58] Field of Search ..... 250/504 R, 504 H; 315/39, 248, 236, 267, 344; 313/110, 113

[56] References Cited

U.S. PATENT DOCUMENTS

| | | | |
|---|---|---|---|
| 3,136,890 | 6/1964 | Wain | 250/504 H |
| 3,872,349 | 3/1975 | Spero et al. | 315/39 |
| 3,911,318 | 10/1975 | Spero et al. | 250/504 R |
| 4,298,806 | 11/1981 | Herold | 250/504 H |
| 4,359,668 | 11/1982 | Ury | 250/504 R |
| 4,532,427 | 7/1985 | Matthews et al. | 250/504 R |
| 4,641,033 | 2/1987 | Petelin et al. | 250/504 R |
| 4,710,638 | 12/1987 | Wood | 250/504 R |
| 4,928,040 | 5/1990 | Uesaki | 315/248 |

*Primary Examiner*—Jack I. Berman
*Assistant Examiner*—Kiet T. Nguyen
*Attorney, Agent, or Firm*—Wegner, Cantor, Mueller & Player

[57] ABSTRACT

An ultra violet rays generator by means of microwaves excitation which comprises a microwave generator for generating microwaves, a microwave cavity directly connected to said microwave generator, an ultra violet ray (UV) reflector having a window for introducing microwaves on the upper part thereof, detachably secured in said microwave cavity, and an ultra violet rays lamp disposed under said window and near the inside of said UV reflector, said UV reflector being composed of a light-transmitting base, and an inteference film formed on said base. According to the generator, it is detachable of only the UV reflector without changing the capacity of the microwave cavity, and thus becoming changeable of only the directions or configurations of the UV without changing microwave efficiency of the microwave cavity, and furthermore, it can obtain the UV of low temperature, exclusive of infra red rays originally included in the UV. Moreover, the mechanism thereof is simplified by omitting the wave guide, and thus, it becomes easy for the production thereof.

4 Claims, 3 Drawing Sheets

ULTRA VIOLET RAYS GENERATOR BY MEANS OF MICROWAVE EXCITATION

BACKGROUND OF THE INVENTION

1. Field of the Invention

The present invention relates to an ultra violet rays generator (UV generator) by means of microwaves exitation comprising a step of irradiating a microwaves to an ultra violet rays lamp (UV lamp), such as an electrodeless lamp etc. in a microwave cavity, and more particularly, to a UV generator detachable of an ultra violet rays reflector (UV reflector) from focus ray type to parallel rays type etc., without changing the capacity of a microwave cavity (impedance), and thus, becoming changeable of rays, for example, from focus rays to parallel rays or contrary to this without changing microwave efficiency, and furthermore possible of obtaining UV of low temperature excluding infra red rays (IR), and thus, becoming possible of the irradiation in high efficiency to the substrates which hate high temperature heat, such as plastics, and moreover, to a UV generator in which a mechanism is simplified by omitting a wave guide.

2. Description of the Prior Art

There are conventionally known UV generators, such as a UV generator shown in FIG. 4, which is a prior application by the same applicant. (c.f. Japanese Utility Model application Ser. No. 1211264/1987)

The UV generator shown in FIG. 4 consists of a microwave generator 2 having a microwave antenna 1, a microwave guide 3 connected to the microwave generator 2 in such a manner that said microwave antenna 1 is projected thereinto, a microwave cavity 6 having an upper wall 5 in which a slot 4 is bored, connected to said microwave guide 3 in such a manner that said slot 4 is faced to said microwave antenna 1, an ultra violet rays (UV) reflector 8 having a window 7 for introducing microwave on the upper part thereof, detachably secured in said microwave cavity 6, and an ultra violet rays lamp 9 disposed under said window 7 and near the inside of said UV reflector 8, said UV reflector 8 being detachably secured by inserting the edges 10, 10 thereof into the bottom 11 of the microwave cavity. Furthermore, the UV reflector 8 is obtained by forming an interference film 13 on a light-transmitting base 12 shown in FIG. 3.

According to the afore-mentioned generator of the prior invention, the microwaves 14 of, for example, 2450 MHZ are, at first, generated from the microwave antenna 1 by the microwave generator 2. The generated microwaves 14 are efficiently introduced into the microwave cavity 6 through the wave guide 3 from the slot 4 of the upper wall 5, and in this microwave cavity 6, a UV lamp 9 is irradiated and exited with the microwaves 14 to generate UV 15. The obtained UV 15 are given to penetratively exclude infra red rays (IR) therefrom by the effect of the interference film 13 of the UV reflector 8, and to reflect only the residual UV in the main, and then, are supplied to irradiate the substrates which are not shown in the drawings through the mesh 16. The said UV are low temperature since it is given to exclude IR therefrom, which are originally included in the UV.

Furthermore, the UV reflector 8 is detachable without changing the capacity of the microwave cavity 6 since it is detachably secured in the microwave cavity 6, different from the wall of the microwave cavity 6, and thus, the microwave efficiency are not changed at all even though for example, a focus type UV reflector 8 is substituted by a parallel type, and then, it can be possible of changing only the directions or configurations of the UV.

The prior generator is detachable of only the UV reflector without changing the capacity of the microwave cavity, and thus becoming changeable of the directions or configurations of the UV without changing the microwave efficiency of the microwave cavity, and furthermore, it can obtain the UV of low temperature, exclusive of infrared rays (IR) originally included in said UV.

However, the mechanism of said prior generator is complicated because of the existence of said wave guide.

SUMMARY OF THE INVENTION

It is an object of the present invention to provide a UV generator wherein the disadvantages found in the prior are overcome, that is, the mechanism thereof is simplified by omitting a wave guide.

It is another object of the present invention to provide such a UV generator wherein it is detachable of only a UV reflector without changing the capacity of a microwave cavity (impedance) from focus ray type to parallel ray type etc., and thus, becoming changeable of the direction of the UV without changing the microwave efficiency.

It is furthermore another object of the present invention to provide such a UV generator wherein it is possible of obtaining a UV of low temperature excluding IR.

According to the present invention, the above objects are accomplished by providing an ultra violet rays generator by means of microwaves excitation comprising a microwave generator for generating microwaves from a microwave antenna connected thereto, a microwave cavity connected to said microwave generator, and ultra violet ray (UV) reflector, detachably secured in the cavity, having a window formed in the upper part thereof for introducing microwaves, and an ultra violet rays lamp disposed under the window. The microwave cavity is connected directly to the microwave generator so that the antenna of the microwave generator extends into the cavity. The UV reflector is composed of a light-transmitting base having an interference film formed thereon.

DETAILED DESCRIPTION

The present invention is illustrated in detail with the attached drawings.

Figure 1:
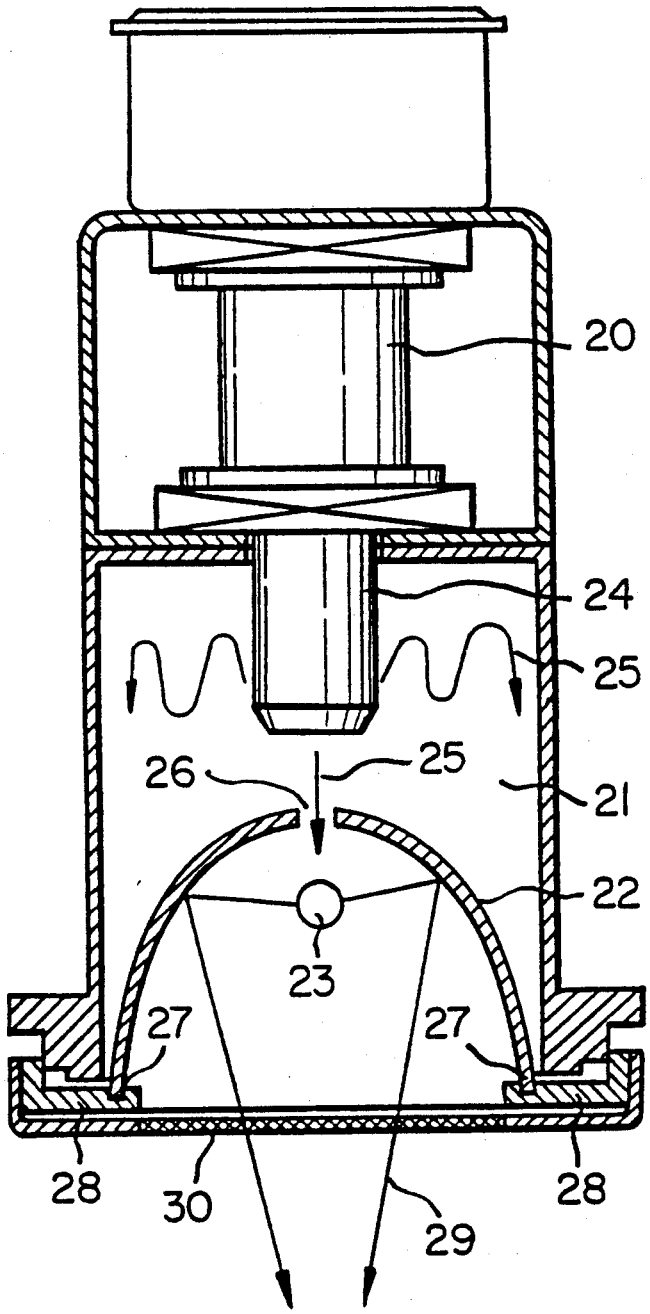
FIG. 1 shows a cross sectional view of one embodiment of the generator in accordance with the present invention.

The generator of the present invention comprises a microwave generator 20 for generating microwaves, a microwave cavity 21. UV reflector 22 and a UV lamp 23 as shown in FIG. 1. The microwave generator 20 can be any type of prior arts, such as a fixed power type with permanent magnets. An electron tube is designated as an example of such type of microwave generator, in which a flow of electrons is controlled by magnetic fields added at right angles into coaxially radiated electric fields, and which is composed by disposing a cathode at a central part thereof, and an anode having even numbered resonance cavities at another circumference thereof. This type of electron tube works in such a manner that when high voltage is applied to the anode, the electrons from the cathode are discharged for the anode, and introduced to the strap (a space) situated at the stop of cathode vanes with a gyrating movement by the power of the magnetic field (parallel to the cathode). At this place, the energy are supplied to the resonance cavities to generate microwaves. This microwaves are discharged as the microwaves 6 from the microwave antenna 24 shown in FIG. 1.

Figure 4:
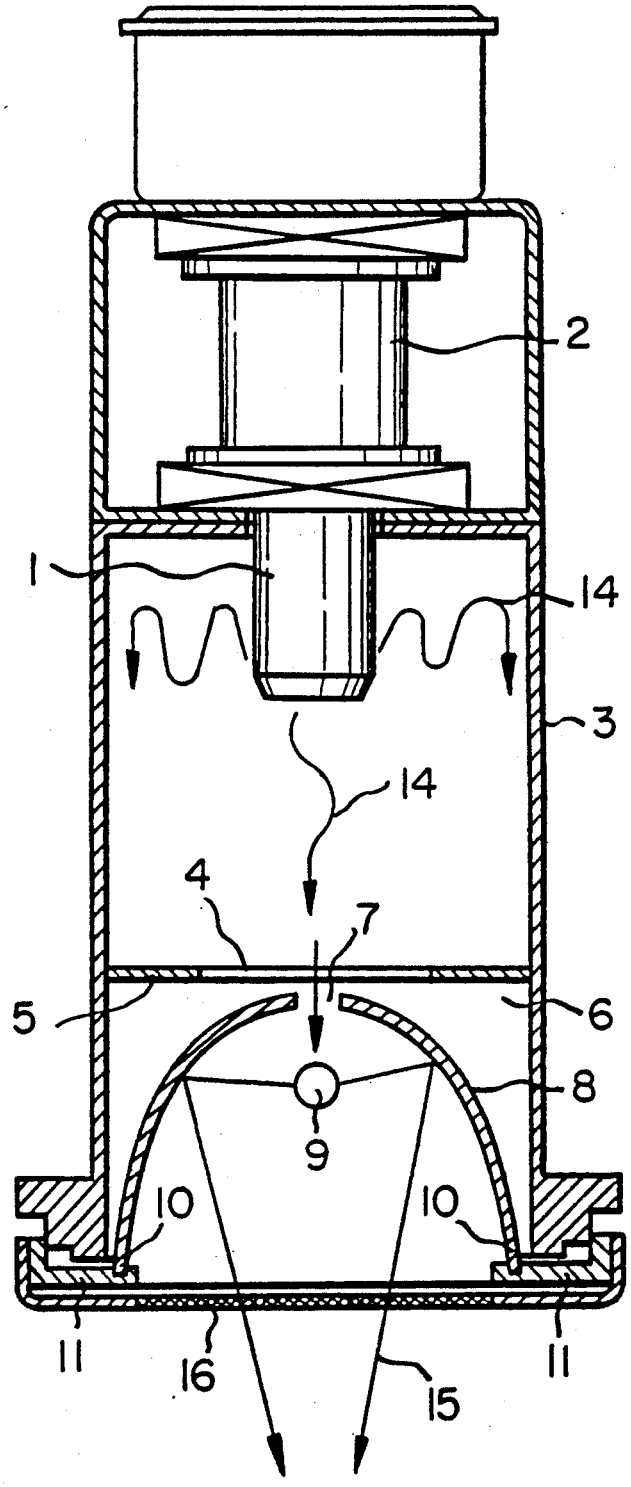
FIG. 4 shows a cross sectional view of one part of a prior art generator.

The microwave cavity 21 is directly connected to said microwave generator 20 in such a manner that a microwave antenna 24 is projected thereinto, and a wave guide 3 and an upper wall 5 in which a slot 4 is bored shown in FIG. 4 of the prior art, are omitted.

Figure 2:
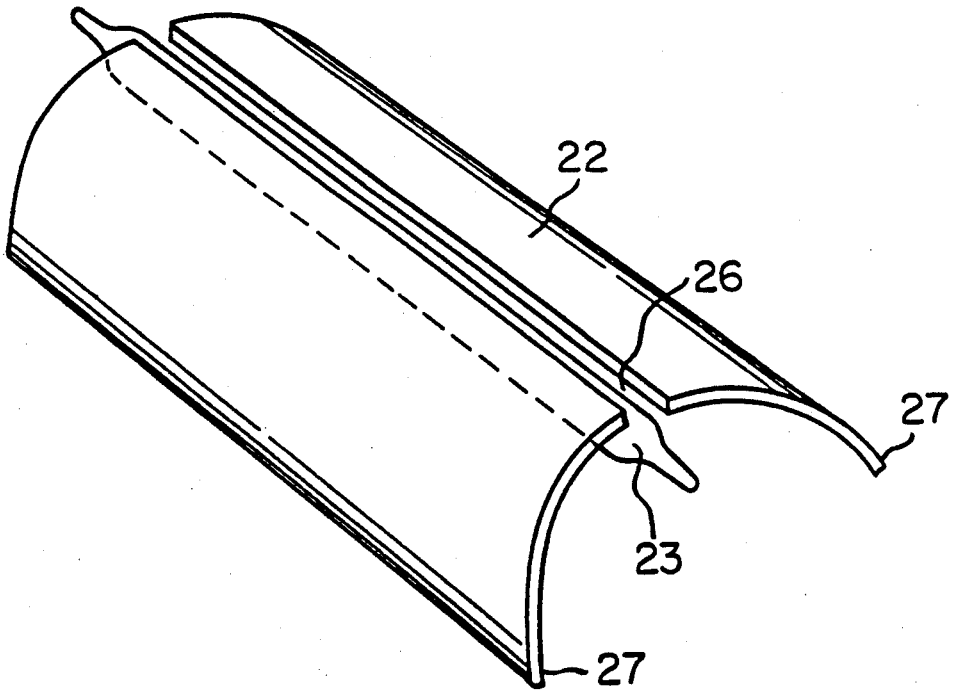
FIG. 2 shows a squint view of one embodiment of the UV reflector and the ultra violet ray lamp used in the present invention, and, FIG. 3 shows a cross sectional view of one embodiment of the UV reflector used in the present invention and prior art generator.
Figure 3:
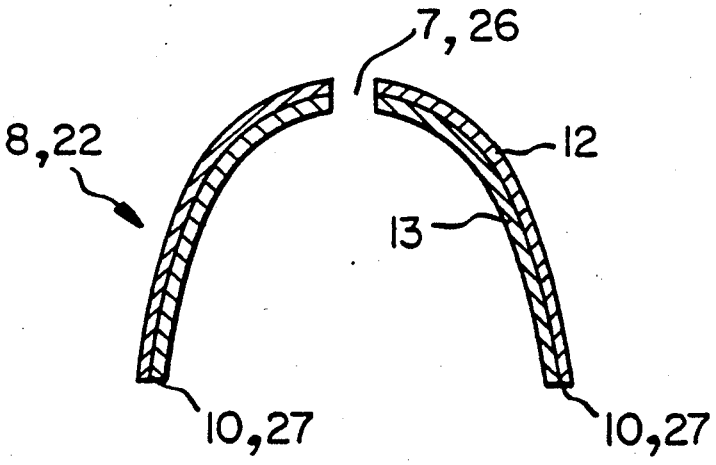

The UV reflector 22 may be formed in the shape of a half-circle having a long and narrow window 26 for introducing microwaves on the upper part thereof, in the cross sectional view shown in FIG. 1, FIG. 2 and FIG. 3, but it can be formed in another shapes freely in accordance with the desired directions or configurations of the rays to be reflected. Furthermore, it can be detachably secured, for example, by inserting the edges 27, 27 thereof into the bottom 28 of the microwave cavity 21 shown in FIG. 1.

Furthermore, the UV reflector 22 is obtained by forming an interference film 13 on a light-transmitting base 12 shown in FIG. 3.

The light-transmitting base 12 consists of a heat-resisting base having light-transmitting characteristics, and the examples thereof are shown as quartz glass, Pyrex glass, etc.

The interference film 13 is an electrically insulating film having a thickness of 2 to 2.2 microns, preferably a thickness of 2.2 microns, which is obtained by vacuum-evaporating zirconium oxide as the first layer of an evaporation film ion the base 12, and subsequently vacuum-evaporating silicon oxide as the second layer of an evaporating film on the first layer, and mutually repeating said steps of vacuum vaporations several ten times. The obtained interference film 13 has such characteristics that sparks with the microwaves 25 are very hard to occur, the rays of long wave length (Infra Red Rays (IR)) and electric waves, respectively, passed therethrough, the energy of microwaves does not be absorbed thereinto, and the reflecting efficiency of the UV is very high.

The UV lamp 23 is, for example, a non-electrode lamp in the shape of a straight pipe, and disposed under the window 26 and near the inside of the UV reflector 22 along with the longitudinal direction of said window 26.

The functions of the present invention are illustrated as follows.

According to the afore-mentioned generator of the present invention, the microwaves 25 of, for example, 2450 MHZ are, at first, generated from the microwave antenna 24 by the microwave generator 20. The generated microwaves 25 are directly and efficiently introduced into the microwave cavity 21 through the window 26, and in this microwave cavity 21, a UV lamp 23 is irradiated and exited with the microwaves 25 to generate UV 29. The obtained UV 29 are given to penetratively exclude infra red rays (IR) therefrom by the effect of the interference film 13 of the UV reflector 22, and to reflect only the residual UV in the main, and then, are supplied to irradiate the substrates which are not shown in the drawings through the mesh 30. The said UV are low temperature since it is given to exclude IR therefrom, which are originally included in the UV.

Moreover, the interference film 13 of UV reflector 22 are not given to spark with the microwaves 25 since it is made from an electrically insulating material.

Furthermore, the UV reflector 22 is detachable without changing the capacity of the microwave cavity 21 since it is detachably secured in the microwave cavity 21, different form the wall of the microwave cavity 21, and thus, the microwave efficiency are not changed at all even though for example, a focus type UV reflector 22 is substituted by a parallel type, and then, it can be possible of changing only the directions or configurations of the UV.

Moreover, the mechanism of the present generator is simplified, and thus, it makes easy for the production of the generator, since the microwave guide 3 and the upper wall 5 having a sot 4 shown in FIG. 4, are omitted.

The effects of the present invention are illustrated as follows. The present generator is detachable of only the UV reflector without changing the capacity of the microwave cavity, and thus becoming changeable of the directions or configurations of the UV without changing the microwave efficiency of the microwave cavity, and furthermore, it can obtain the UV of low temperature, exclusive of infrared rays (IR) originally included in said UV. Moreover, the mechanism is simplified, and thus, becomes easy for the production thereof.

What is claimed is:

1. An ultra violet rays generator which generates ultra violet rays by means of microwave excitation, comprising:

a microwave generator for generating microwaves from a microwave antenna coupled thereto;

a microwave cavity directly connected to said microwave generator so that said antenna extends into said cavity;

an ultra violet ray (UV) reflector detachably secured in said microwave cavity, said reflector having a window formed in the upper part thereof through which microwaves can be transmitted and a light transmitting base having an interference film formed thereon; and an ultra violet lamp disposed under said window and near the inside of said reflector.

2. The generator as claimed in claim 1, wherein said reflector consists of a light-transmitting base and an interference film thereon, having a thickness of 2 to 2.2 microns, and said interference film being formed by vacuum-evaporating the first layer of zirconium oxide on the base and subsequently the second layer of silicon oxide on the first layer, and repeating said vacuum evaporations.

3. The generator as claimed in claim 1, wherein said light-transmitting base consists of a heat-resisting base having light-transmitting characteristics.

4. The generator as claimed in claim 1, wherein said interference film is an electrically insulating film.

* * * * *